US005732914A

United States Patent [19]

Flinn

[11] Patent Number: 5,732,914

[45] Date of Patent: Mar. 31, 1998

[54] GUN HOLDER FOR BEDSIDE PLACEMENT OF RIFLES AND SHOTGUNS

[76] Inventor: John Flinn, 13170 E. Ashlan, Sanger, Calif. 93657

[21] Appl. No.: 614,990

[22] Filed: Mar. 13, 1996

[51] Int. Cl.[6] ..... F16M 11/00

[52] U.S. Cl. ..... 248/201; 248/205.1; 211/64

[58] Field of Search ..... 248/201, 205.1, 248/231.9; 211/64; 5/426, 503.1, 658

[56] References Cited

U.S. PATENT DOCUMENTS

| | | | |
|---|---|---|---|
| 1,914,259 | 6/1933 | Irwin | 211/64 |
| 3,286,967 | 11/1966 | Ferrell | 248/201 X |
| 3,294,247 | 12/1966 | Norrington | 248/201 X |
| 4,375,268 | 3/1983 | Speck | 211/64 X |
| 4,461,442 | 7/1984 | Keenan | 5/503.1 X |
| 4,466,148 | 8/1984 | Jones | 5/503.1 |
| 4,483,501 | 11/1984 | Eddy | 248/205.1 |
| 4,521,930 | 6/1985 | Henson | 5/503.1 X |
| 4,691,396 | 9/1987 | Hoffman | 248/205.1 X |
| 4,869,449 | 9/1989 | Goodman | 248/205.1 |
| 5,111,545 | 5/1992 | Krozal | 5/503.1 |
| 5,400,450 | 3/1995 | Leoutsakos | 5/426 X |
| 5,443,191 | 8/1995 | Jorgenson | 211/64 X |
| 5,577,277 | 11/1996 | Sundberg et al. | 5/426 |

*Primary Examiner*—Daniel P. Stodola
*Assistant Examiner*—Gregory J. Strimbu
*Attorney, Agent, or Firm*—Richard A. Ryan

[57] ABSTRACT

A gun holder for holding a rifle or shotgun on the side of a bed to allow a person lying or sitting in the bed quick and reliable access to a gun in case of an emergency. The gun holder has a horizontal support plate with an upper and a lower surface and a support member attached to one end. The end of the horizontal support plate opposite the end having the support member extends inwardly towards the center of the bed between the mattress and box spring. The support member lies against the bed and can be substantially J-shaped or U-shaped, with both ends open or one end closed. A second horizontal support plate and support member combination is also provided to provide support for the gun. The outward side of the first and second support members can be adapted to further facilitate quick and easy access to the gun. The upper and lower surfaces of the first and second horizontal support plates can be modified to prevent slippage.

17 Claims, 4 Drawing Sheets

GUN HOLDER FOR BEDSIDE PLACEMENT OF RIFLES AND SHOTGUNS

BACKGROUND OF THE INVENTION

The field of the present invention relates generally to devices for holding guns, including rifles and shotguns, securely and conveniently along the side of a bed. Specifically, this invention relates to devices that allow a person lying in bed to quickly and safely access a rifler or shotgun in case of emergency.

In recent years, soaring crime rates have caused many persons to be more concerned about their personal safety while in their own home, particularly at night. As a result, many of these people wish to have ready access to a gun while in bed in case they are awakened by a burglar or other intruder entering their home. However, to be effective, the gun must be readily accessible from a prone or semi-prone position and the person must be able to quickly place the gun in a useable, firing position.

Many logical places currently exist to store a gun at home, including bedside tables, drawers, headboards, under the bed and under a pillow. However, each of these places present problems, such as the possibility that the gun will not be in the position it was left in due to the gun sliding or rotating during use of the storage item. This can result in the gun being out of reach or positioned such that the half-awake person will be fumbling with it in order to place the gun in a useable position. The problems with lost time and the dangers associated with such movement of the gun are self-evident. The present invention solves the problems associated with the bedside storage of guns discussed above by providing a gun holder that positions a gun within easy reach of a person in bed and allows that person to reliably and confidently retrieve the gun in an emergency situation.

Known gun holders illustrate various methods of overcoming the problems addressed by the placement of a gun near a bed. For instance, U.S. Pat. No. 4,461,442 of Keenan discloses a bed pistol holster holder consisting of an L-shaped bracket that is placed between the mattress and box spring to hold a pistol holster for easy access to a pistol. Other patents, such as U.S. Pat. No. 4,466,148 to Jones, U.S. Pat. No. 4,483,501 to Eddy and U.S. Pat. No. 4,691,396 to Hoffman, disclose various other devices for storing a handgun near a bed. However, none of the devices currently available disclose any device suitable for accomplishing the objectives of the present invention.

SUMMARY OF THE INVENTION

The problems associated with storage and retrieval of guns from a prone position in bed outlined above are solved by the gun holder in accordance with the present invention. That is to say, the present invention provides for a gun holder that allows for easy and confident retrieval of a gun while lying or sitting in bed.

The gun holder of the present invention can be constructed of an inexpensive, light weight material such as plastic or the like, although materials such as metal and wood are also suitable. The gun holder comprises a horizontal support plate having an upper and a lower surface and a support member attached to one end of the horizontal support plate. The support member lies against the bed and the end of the horizontal support plate opposite the end having the support member extends inwardly towards the center of the bed between the mattress and box spring. The support member can be substantially J-shaped or U-shaped, with both ends open or one end closed. A second horizontal support plate and support member combination is provided in order to support the weight of the gun. The outward side of the support member can be adapted to further facilitate quick and easy access to the gun.

In use, the two horizontal support plates are placed between the mattress and box spring on a bed such that the support members are flush against the bed and sufficiently spaced apart to accept the desired rifle or shotgun. The weight of the mattress and the friction between the upper and lower surfaces of the horizontal plates and the mattress or box spring prevents any unwanted movement of the support members. One end of the gun, either the barrel or the butt end depending which side of the bed the gun holder is placed on, is placed in one of the support members and the other end of the gun is placed in the other support member. In case of emergency, the person lying in bed can quickly and confidently retrieve the gun and be able to immediately place it in a useable and firing position.

Accordingly, the primary objective of the present invention is to provide an inexpensive yet effective gun holder for a bed that is receivable between the mattress and box spring and is adaptable for holding a rifle or shotgun in an easily accessible manner.

Another objective of the present invention is to provide a gun holder for a bed that comprises two horizontal plates, each with a support member perpendicularly attached at one end of each horizontal plate, wherein each support member is adapted for holding either the butt end or the barrel end of a rifle or shotgun and the horizontal plate is adapted to be held in place between the mattress and box spring of the bed such that the support member is placed against the bed. Alternatively, the gun holder can be comprised of a single horizontal plate having one or more support members suitable for holding a rifle or shotgun adjacent to the bed.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
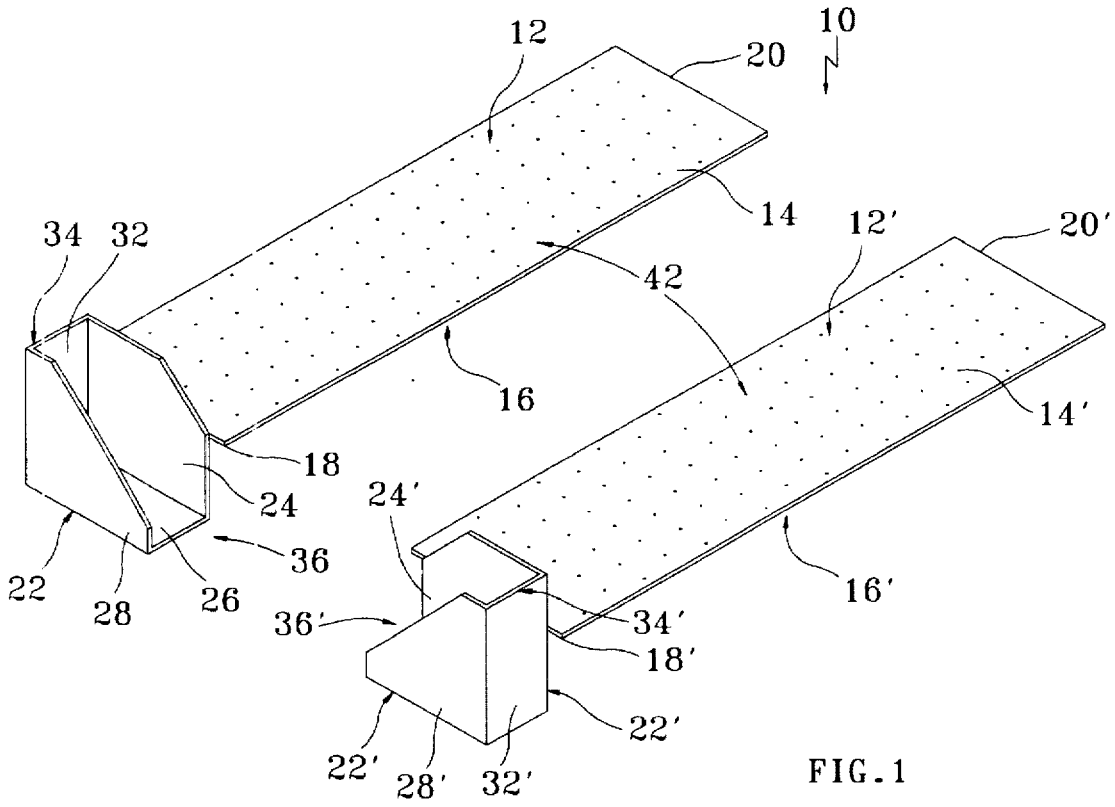
FIG. 1 is a perspective view of the bun holder illustrating the use of two horizontal plates, each having a support member attached thereto.
Figure 2:
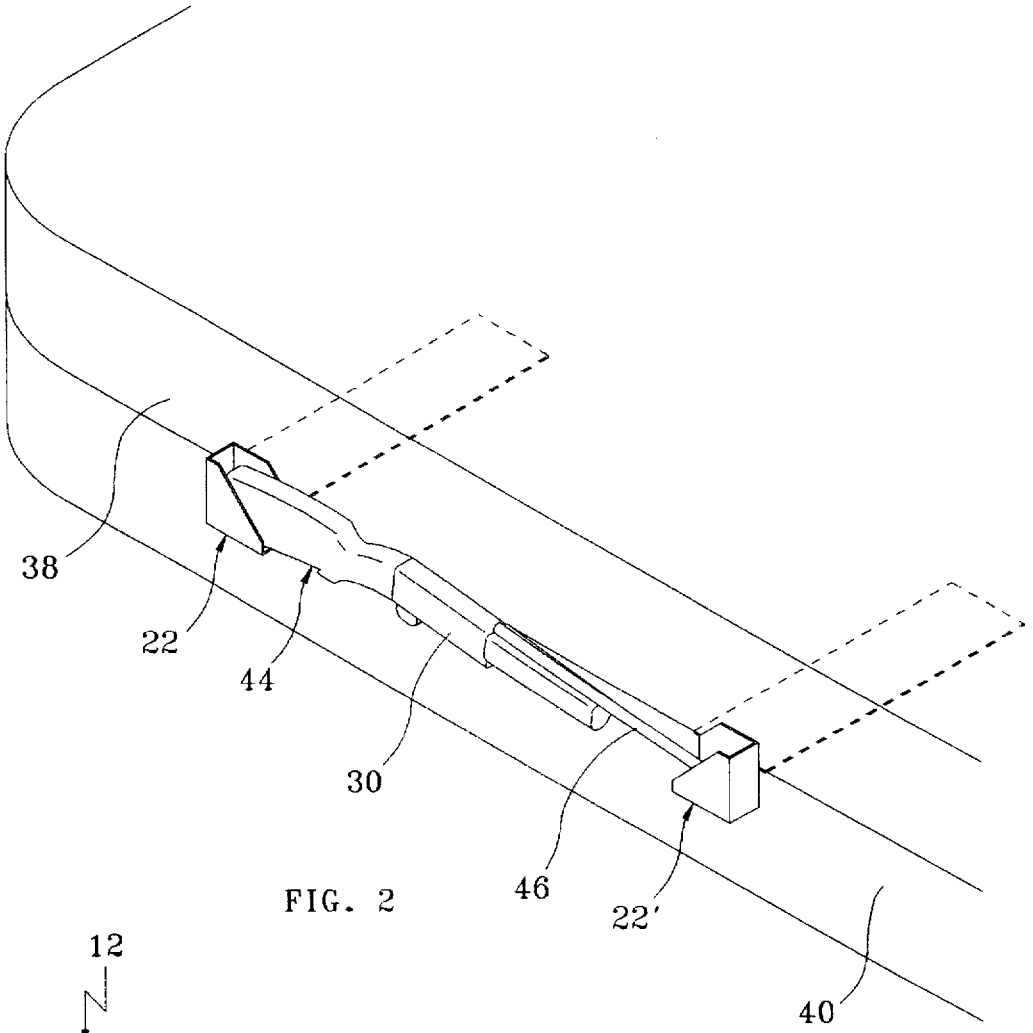
FIG. 2 is a perspective view of the gun holder in use.

One embodiment of the gun holder, designated generally 10, is illustrated in FIGS. 1 and 2. The gun holder 10 includes a first horizontal plate 12 having an upper surface 14, a lower surface 16, an outer edge 18 and an inner edge 20. A first support member, designated generally as 22, having a first substantially vertical panel 24 is attached to the outer edge 18 of the first horizontal plate 12, a substantially horizontal panel 26 extends outwardly from the first substantially vertical panel 24 and a second substantially vertical panel 28 extends perpendicularly from the horizontal panel 26, thereby forming a J-shaped or U-shaped member. The second vertical panel 28 can be adapted to facilitate easy removal of the gun 30 by modifying the shape of panel 28, as illustrated in FIGS. 1 and 2, or by other methods as are known in the art. To securely keep the gun 30 in place, an end panel 32 can be attached to one end of the first support member 22, forming a closed end 34 and an open end 36 of the first support member 22.

The gun holder 10 illustrated in FIGS. 1 and 2 also includes a second horizontal plate 12' having an upper surface 14', a lower surface 16', an outer edge 18' and an inner edge 20'. A second support member, designated generally as 22', having a first substantially vertical panel 24' is attached to the outer edge 18' of the first horizontal plate 12', a substantially horizontal panel (not shown) extends outwardly from the first substantially vertical panel 24' and a second substantially vertical panel 28' extends perpendicularly from the horizontal panel 26', thereby forming a J-shaped or U-shaped member. The second vertical panel 28' of the second support member 22' can also be adapted to facilitate easy removal of the gun 30. To securely keep the gun 30 in place, an end panel 32' can be attached to one end of the second support member 22', forming a closed end 34' and an open end 36° of the first support member 22'.

Figure 3:
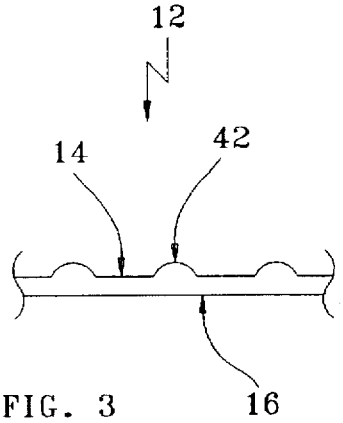
FIG. 3 is a side view showing the use of raised bumps on the upper surface of a horizontal support plate.

The first horizontal plate 12 and the second horizontal plate 12' can be adapted to further prevent slippage between the mattress 38 and box spring 40. One such form of adaptation, shown on FIGS. 1 and 2, is the addition of a plurality of raised areas 42 on the upper surfaces 14 and 14'. As shown in FIG. 3, the raised areas 42 are configured and shaped so as to prevent slippage and can be made integral to the first and second horizontal plates 12 and 12', as is known in the art. Although not shown, the lower surfaces 16 and 16' can, either in addition to or as an alternative to the adaptation described above, be adapted to prevent slippage between the mattress 38 and box spring 40. As is well known in the art, other adaptations to the first and second horizontal plates 12 and 12' to prevent or reduce slippage of the gun holder 10 are possible.

In use, the first horizontal plate 12, with the upper surface 14 facing up, is inserted between the mattress 38 and box spring 40 until the first vertical panel 24 of the first support member 22 abuts against the mattress 38 or box spring 40. The second horizontal plate 12', with the upper surface 14' facing up, is inserted between the mattress 38 and box spring 40 at a point away from the first support member 22 approximating the length of the gun 30, such that the open end 36' of the second support member 22' faces the open end 36 of the first support. member 22. The second support member 22' is inserted until the first vertical panel 24' abuts against the mattress 38 or box spring 40. The gun 30 is placed in the first and second support members 22 and 22' of the gun holder 10 such that the butt end 44 of the gun 30 is close to a person lying or sitting in bed and such that the side of the gun 30 is in a substantially upright position. As shown in FIG. 2, this would require the butt end 44 to be placed in the first support member 22 and the barrel end 46 to be placed in the second support member 22'. The entire gun holder 10 and gun 30 combination could be moved to where a person in bed could conveniently and confidently access the gun 30 in an emergency.

Alternative embodiments of the above gun holder includes the use of single-piece support members 22 and 22', such as would result from molding the support members 22 and 22' from plastic. In addition, the horizontal support plate 12 and the support member 22 could also be made as a single piece, as could the horizontal support plate 12' and support member 22'.

Figure 4:
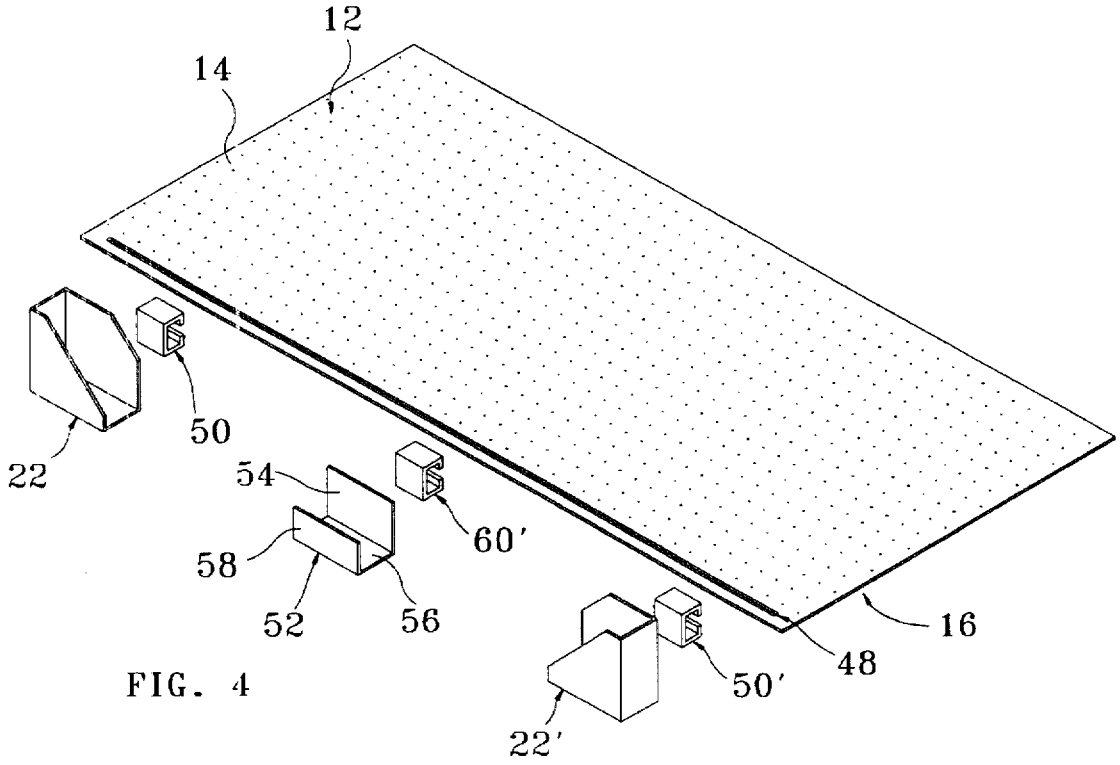
FIG. 4 is a partially exploded view of another embodiment of the gun holder showing a single horizontal support plate and the use of slideably attached support members.

Another embodiment of the gun holder is shown in FIG. 4. In this embodiment, the gun holder is comprised of a single horizontal support plate 12 that has a pair of support members 22 and 22', as described above. Although not shown, the support members 22 and 22' can be fixedly attached to the horizontal support plate 12 at various pre-set distances apart based on typical gun lengths. Alternatively, as shown in FIG. 4, the support members 22 and 22' can be slideably attached to the horizontal support plate 12 using a groove 48 cut into the horizontal support plate 12 and a pair of C-shaped sliding members 50 and 50' attached to the first vertical panels 24 and 24' of the support members 22 and 22' respectively, that permits the support members 22 and 22' to slide along the groove 48. The groove 48 can be cut into either or both the upper surface 14 and the lower surface 16 of the horizontal support plate 12. To prevent the support members 22 and 22' from unwanted sliding, the sliding members 50 and 50' can be provided with a mechanism to close the ends of the C-shaped sliding members 50 and 50' into the groove 48 to fixedly secure the support members 22 and 22' into the desired locations.

The embodiment described above and illustrated in FIG. 4 can be further modified by using various other methods to slideably attach the support members 22 and 22' to the horizontal support plate 12. For instance, although not illustrated, the horizontal support plate 12 can have a serrated edge either along or inside the groove 48 to permit controlled movement of the support members 22 and 22', particularly if no method of securely attaching the support members 22 and 22' is utilized. To add support for longer rifles or shotguns, at least one substantially J-shaped support member 52 can be attached, either fixedly or slideably, to the horizontal support plate 12 between the support members 22 and 22'. As show in FIG. 4, the J-shaped support member 52 would have a first substantially vertical panel 54, a substantially horizontal panel 56 and a second substantially vertical panel 58. In the embodiment shown in FIG. 4, a substantially C-shaped sliding member 60 slideably attaches the J-shaped support member to the horizontal support plate 12. As with support members 22 and 22', the sliding member 60 can be provided with a mechanism to secure the J-shaped support member 52 in place.

Figure 5:
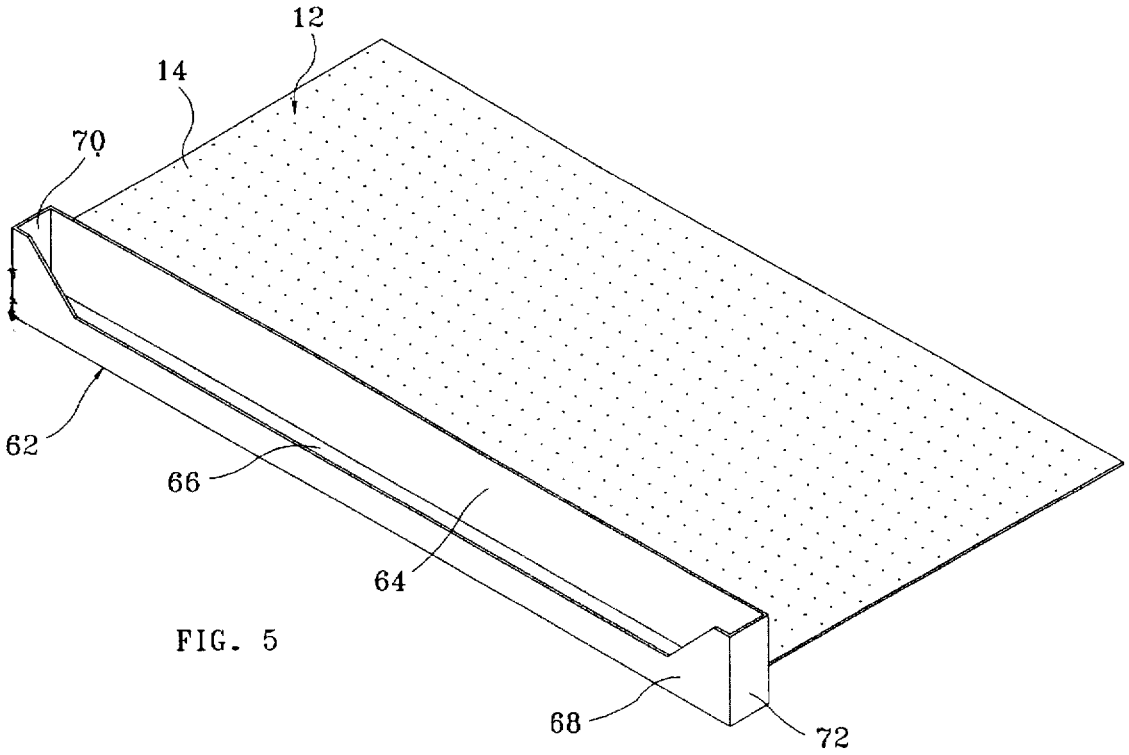
FIG. 5 is a perspective view of another embodiment of the gun holder showing a single horizontal support plate and a single support member.

Another embodiment of the gun holder is shown in FIG. 5. In this embodiment, the gun holder is comprised of a single horizontal support plate 12 and a single support member 62 having a first substantially vertical panel 64, a substantially horizontal panel 66 and a second substantially vertical panel 68. In the embodiment shown in FIG. 5, the support member 62 is fixedly attached to the horizontal support plate 12, the second vertical panel 68 is shaped to permit easy access to the gun yet hold it securely in place when not in use, and end plates 70 and 72 are attached to both ends of the support member 62 to prevent the gun from sliding out of the support member 62.

While there is shown and described herein certain specific alternative forms of the invention, it will be readily apparent to those skilled in the art that the invention is not so limited, but is susceptible to various modifications and rearrangements in design and materials without departing from the spirit and scope of the invention.

I claim:

1. A gun holder for supporting a gun having two ends, a butt end and a barrel end, on a side of a bed for ready use, comprising, in combination:

a first horizontal support plate having an upper surface, a lower surface, an outer edge adapted to lie adjacent to an edge of the bed and an inner edge adapted to lie inwardly from the edge of the bed, said first horizontal support plate constructed and configured to extend inwardly from the edge of the bed toward a center of the bed;

a first support member attached to said outer edge of said first horizontal support plate, said first support member constructed and configured to abut the side of the bed and removably hold one of the butt end and barrel end of the gun, said first support member being open on at least two sides to allow easy placement and removal of the gun from said first support member;

a second horizontal support plate having an upper surface, a lower surface, an outer edge adapted to lie adjacent to the edge of the bed and an inner edge adapted to lie inwardly from the edge of the bed, said second horizontal support plate constructed and configured to extend inwardly from the edge of the bed toward the center of the bed;

a second support member attached to said outer edge of said second horizontal support plate, said second support member constructed and configured to abut the side of the bed and removably hold the end of the gun opposite that held by said first support member, said second support member being open on at least two sides to allow easy placement and removal of the gun from said second support member, wherein said first support member comprises a first substantially vertical panel extending perpendicularly from said outer edge of said first horizontal support plate, a substantially horizontal panel extending outwardly from said first substantially vertical panel and a second substantially vertical panel extending perpendicularly from said substantially horizontal panel, said first substantially vertical panel, said substantially horizontal panel and said second substantially vertical panel forming a substantial U-shape; and said first support member further comprises an end plate attached to one end of said first and said second substantially vertical panels and said substantially horizontal panel, wherein said end plate forms a closed end of said first support member opposite an open end of said first support member, wherein said open end of said first support member faces toward said second support member.

2. A gun holder according to claim 1, wherein said second substantially vertical panel is shaped to allow easy access to the gun.

3. A gun holder according to claim 1, wherein said second support member comprises a first substantially vertical panel extending perpendicularly against said outer edge of said second horizontal support plate, a substantially horizontal panel extending outwardly from said first substantially vertical panel and a second substantially vertical panel extending perpendicularly from said substantially horizontal panel, said first substantially vertical panel, said substantially horizontal panel and said second substantially vertical panel forming a substantial U-shape.

4. A gun holder according to claim 3, wherein said second support member further comprises an end plate attached to one end of said first and said second substantially vertical panels and said substantially horizontal panel, wherein said end plate forms a closed end of said second support member opposite an open end of said second support member, wherein said open end of said second support member faces toward said first support member.

5. A gun holder according to claim 1, wherein said upper surface of said first and said second horizontal support plates comprise a plurality of raised areas to prevent movement of said first and second horizontal support plates relative to the bed.

6. A gun holder according to claim 1, wherein said lower surface of said first and said second horizontal support plates comprise a plurality of raised areas to prevent movement of said first and second horizontal support plates relative to the bed.

7. A gun holder according to claim 1, wherein said first and second support members are constructed and configured to hold the gun in a horizontal position when placed in said gun holder.

8. A gun holder for supporting a gun having two ends, a butt end and a barrel end, on a side of a bed for ready use, comprising, in combination:

a horizontal support plate having an upper surface, a lower surface, an outer edge adapted to lie adjacent to an edge of the bed and an inner edge adapted to lie inwardly from the edge of the bed, said horizontal support plate constructed and configured to extend inwardly from the edge of the bed toward a center of the bed;

a pair of support members, each support members is constructed and configured to abut the side of the bed and to removably hold one end of the gun; and sliding means for slideably attaching at least one of said pair of support members to said outer edge of said horizontal support plate for adjusting a distance between said pair of support members to accommodate various gun lengths.

9. A gun holder according to claim 8, wherein at least one of said pair of support members comprises a first substantially vertical panel extending perpendicularly against said outer edge of said horizontal support plate, a substantially horizontal panel extending outwardly from said first substantially vertical panel and a second substantially vertical panel extending perpendicularly from said substantially horizontal panel, said first substantially vertical panel, said substantially horizontal panel and said second substantially vertical panel forming a substantial U-shape.

10. A gun holder according to claim 9, wherein said second substantially vertical panel is shaped to allow easy access to the gun.

11. A gun holder according to claim 9, wherein said at least one of said pair of support members further comprises an end plate attached to one end of said first and said second substantially vertical panels and said substantially horizontal panel, wherein said end plate forms a closed end opposite an open end of said at least one of said pair of support members, wherein said open end is in spatial communication with the other of said pair of support members.

12. A gun holder according to claim 8, wherein said sliding means is adapted to allow controlled movement of said at least one of said pair of support members along said outer edge of said horizontal support plate.

13. A gun holder according to claim 8, wherein said gun holder further comprises securing means for fixedly securing said at least one of said pair of support members to said horizontal support plate to prevent unwanted movement of said at least one of said pair of support members.

14. A gun holder according to claim 8, wherein said gun holder further comprises at least one substantially U-shaped support member attached to said outer edge of said horizontal support plate, said U-shaped support member constructed and configured to lie against the side of the bed, said U-shaped support member being interposed between said pair of support members, wherein said at least one substantially U-shaped support member is open at both ends.

15. A gun holder according to claim 8, wherein said upper surface of said horizontal support plate comprises a plurality of raised areas to prevent movement of said horizontal support plate relative to the bed.

16. A gun holder for supporting one of a rifle and shotgun having two ends, a butt end and a barrel end, on a side of a bed for ready use, comprising, in combination:

a horizontal support plate having an upper surface, a lower surface, an outer edge adapted to lie adjacent to an edge of the bed and an inner edge adapted to lie inwardly from the edge of the bed, said horizontal support plate constructed and configured to extend inwardly from the edge of the bed toward a center of the bed, said horizontal support plate comprising a plurality of raised areas to prevent movement of said horizontal support plate relative to the bed; and a support member attached to said outer edge of said horizontal support plate, said support member comprising a first substantially vertical panel extending perpendicularly against said outer edge of said horizontal support plate, a substantially horizontal panel extending outwardly from said first substantially vertical panel, a second substantially vertical panel extending perpendicularly from said substantially horizontal panel and an end plate attached to each end of said first and said second substantially vertical panels and said substantially horizontal panel, said second substantially vertical panel shaped to allow easy access to one of the rifle and shotgun, said support member constructed and configured to lie against the side of the bed and to removably hold one of the rifle and shotgun.

17. A gun holder according to claim 16, wherein said first vertical panel and said second vertical panel are constructed and configured to hold one of the rifle and shotgun in a substantially horizontal position when placed in said support member.

* * * * *